US006294079B1

(12) United States Patent
Thakkar et al.

(10) Patent No.: US 6,294,079 B1
(45) Date of Patent: Sep. 25, 2001

(54) HIGH SEVERITY, LOW CONVERSION HYDROCRACKING PROCESS

(75) Inventors: Vasant P. Thakkar, Elk Grove Village; Christopher J. Anderle, Schaumburg; Hemant B. Gala, Arlington Heights, all of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/422,316

(22) Filed: Oct. 21, 1999

(51) Int. Cl.[7] ..... C10G 65/00
(52) U.S. Cl. ..... 208/59; 208/58; 208/89
(58) Field of Search ..... 208/58, 59, 89

(56) References Cited

U.S. PATENT DOCUMENTS 3,260,663 7/1966 Inwood et al. ..... 208/59
3,471,397 10/1969 Fortman ..... 208/111
3,733,260 5/1973 Davies et al. ..... 208/212
3,779,897 * 12/1973 Wrench et al. ..... 208/89

OTHER PUBLICATIONS

Scherzer, J. et al. Hydrocracking Processes *Hydrocracking Science and Technology* (Marcel Dekker, Inc., 1986) pp. 174–183 ISBN 0–8247–9760–4 TP690.4.S34.

* cited by examiner

*Primary Examiner*—Helane E. Myers
(74) *Attorney, Agent, or Firm*—John G. Tolomei; John F. Spears, Jr.

(57) ABSTRACT

A feed stream is first processed in a hydrotreating reaction zone and then the effluent is separated into three fractions in an augmented first high pressure separator. Controlled portions of the middle and heavy hydrocarbon fractions are passed into a high severity hydrocracking zone, while the remaining portions of these two fractions are passed into a second high pressure separator for recovery. The effluent of the hydrocracking zone is also fed to the second high pressure separator.

9 Claims, 1 Drawing Sheet

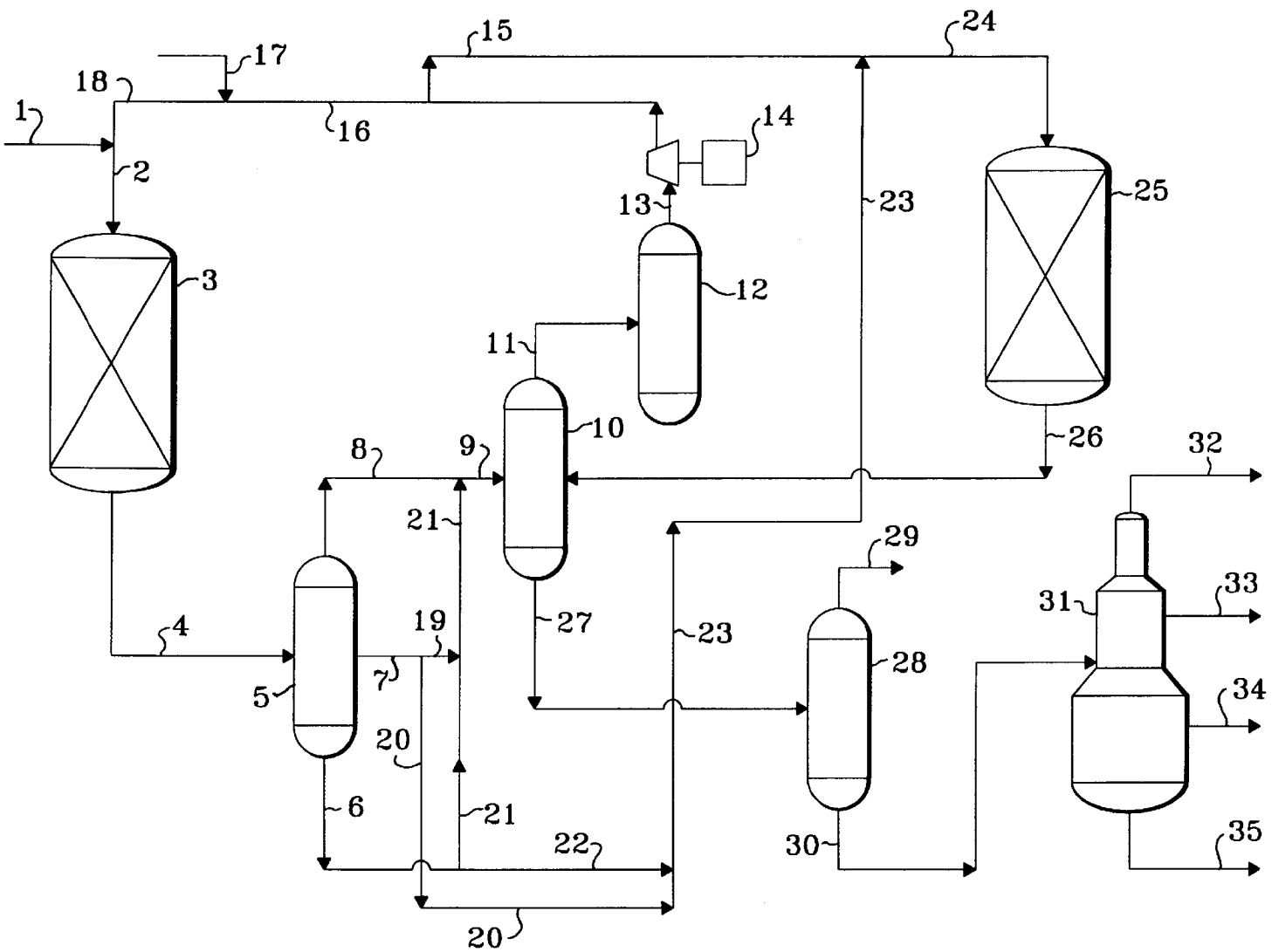
1
2
3
4
5
6
7
8
9
10
11
12
13
14
15
16
17
18
19
20
21
22
23
24
25
26
27
28
29
30
31
32
33
34
35

HIGH SEVERITY, LOW CONVERSION HYDROCRACKING PROCESS

FIELD OF THE INVENTION

The invention relates to a hydrocarbon conversion process referred to in the art as hydrocracking, which is used commercially in petroleum refineries to reduce the average molecular weight of heavy or middle fractions of crude oil. The invention more directly relates to an integrated hydrotreating/hydrocracking process which has a specific product separation arrangement. The invention is specifically related to the separation of the effluent of the hydrotreating zone using sequential high pressure separators.

BACKGROUND OF THE INVENTION

Large quantities of petroleum derived hydrocarbons are converted into higher value hydrocarbon fractions used as motor fuel by a refining process referred to as hydrocracking. In this process the heavy feed is contacted with a fixed bed of a solid catalyst in the presence of hydrogen at conditions of high temperature and pressure which results in a substantial portion of the molecules of the feed stream being broken down into molecules of smaller size and greater volatility. The high economic value of petroleum fuels derived from the smaller molecules has led to extensive development of both hydrocracking catalysts and the process technology.

The raw petroleum fractions contain significant amounts of organic sulfur and nitrogen. The sulfur and nitrogen must be removed to meet modern fuel specifications. Removal or reduction of the sulfur and nitrogen is also beneficial to the operation of a hydrocracking reactor. The sulfur and nitrogen is removed by a process referred to as hydrotreating. Due to the similarity of the process conditions employed in hydrotreating and hydrocracking the two processes are often integrated into a single overall process unit having separate sequential reactors dedicated to the two reactions and a common product recovery section.

RELATED ART

Both hydrotreating and hydrocracking are widely practiced commercial processes. The very significant economic utility of the hydrocracking process has resulted in a large effort devoted to the improvement of the process and to the development of better catalysts for use in the process. A general review and classification of different hydrocracking process flow schemes and a description of hydrocracking catalysts is provided at pages 174–183 of the book entitled *Hydrocracking Science and Technology* authored by Julius Scherzer and A. J. Gruia published in 1996 by Marcel Dekker, Inc. FIGS. 10.2, 10.3 and 10.5 show hydrotreating reactors upstream of the hydrocracking reactor and general process flow schemes. As noted therein it is an established practice to first pass a hydrocracking unit feed stream into a hydrotreating reactor in order to reduce the level of sulfur and nitrogen tied up in the target petroleum molecules. Some form of separation may be employed between the hydrotreating reactor and the hydrocracking reactor to reduce the amount of hydrogen sulfide carried over to the hydrocracking reactor with the hydrocarbon phase.

The high pressures employed in hydrocracking has prompted efforts to conserve the pressure of any portion of the hydrocracking effluent which is to be recycled and also to limit reductions in pressure as a separation mechanism to the product recovery section of the process. The effluent of a high pressure reactor such as a hydrocracking reactor therefore typically flows into a vessel referred to as a high pressure separator (HPS), which operates at a pressure close to the outlet pressure of the reaction zone. High pressure separators are classified as "hot" or "cold" depending on whether the effluent stream is cooled significantly prior to passage into the HPS.

U.S. Pat. No. 3,260,663 issued to T. V. Inwood et al, illustrates the passage of the effluent of an initial hydrotreater 8 into a separator 14 which may be operated at close to the conditions employed in the hydrotreater. The separator contains trays 24, and hydrogen may be charged to the bottom of the separator via line 28. A vapor-phase comprising 650° F.–minus hydrocarbons and hydrogen and a hydrocarbon liquid phase are removed from the separator and passed into separate hydrocracking reactors. The effluent of both hydrocracking reactors shown in FIG. 1 is handled in a more conventional manner with the effluent first flowing into a HPS and then the liquid from the HPS flowing into a low pressure separator 66.

The art also includes more complicated separation schemes employing multiple separators. For instance, U.S. Pat. No. 3,471,397 issued to J. T. Fortman et al illustrates the use of a HPS, a hot flash separator and a cold separator. U.S. Pat. No. 3,733,260 issued to J. A. Davies et al shows the use of a hot separator, a hot flash separator, a cold separator and a cold flash separator. This reference also illustrates the practice of treating the recycle hydrogen gas stream to remove hydrogen sulfide.

SUMMARY OF THE INVENTION

The invention is a hydrocarbon conversion flow scheme employing two high pressure separators in series to separate the effluent of a hydrotreating reactor in order to provide controlled division of intermediate and heavy hydrocarbons between a relatively high severity hydrocracking zone and the product recovery zone of the process. The first high pressure separator is augmented to provide an acceptable division of the hydrotreating reactor effluent hydrocarbons into light, intermediate and heavy fractions, with only a portion of the intermediate and heavy fractions being passed into the second high pressure separator, which produces the liquid passed to the product recovery zone. Bypassing hydrocarbons around the hydrocracking zone results in an overall low conversion process.

A broad embodiment of the invention may be characterized as an integrated hydrocarbon conversion process which employs both a hydrocracking reactor and a hydrotreating reactor, which process comprises passing a feed stream comprising hydrocarbons having boiling points above 400° F. and hydrogen into a hydrotreating reaction zone operated at hydrotreating conditions and producing a hydrotreating reaction zone effluent stream comprising hydrogen, hydrogen sulfide, and hydrocarbons having boiling points above about 400° F.; separating the hydrotreating reaction zone effluent stream in an augmented high pressure separation zone into a light fraction comprising hydrocarbons having boiling points below about 300° F., an intermediate fraction which is rich in hydrocarbons having boiling points between about 300° F. and about 700° F., and a heavy fraction comprising hydrocarbons having boiling points above about 700° F., passing the light fraction and a controlled first portion of each of the intermediate and heavy fractions into a second high pressure separator, passing a remaining second portion of the intermediate and heavy fractions and hydrogen into a hydrocracking reaction zone operated at hydrocracking conditions, and producing a hydrocracking reaction zone effluent stream, passing the hydrocracking reaction zone effluent stream into the second high pressure separator, and passing a liquid recovery zone, and recovering at least one distillate hydrocarbon product stream.

BRIEF DESCRIPTION OF THE DRAWING

The drawing is a simplified process flow diagram showing a feed stream entering a hydrotreating reactor 3, with the effluent of this reactor flowing into the first of two high pressure separators 5 and 10 employed in the process.

DETAILED DESCRIPTION AND PREFERRED EMBODIMENTS

Much of the crude petroleum which is produced cannot be used directly as a modern fuel or petrochemical feed stock. It must be refined to remove sulfur and nitrogen which would increase air pollution if present in a fuel. It must also be refined to reduce the average molecular weight of the heavier components of the crude such that the volatility or flow characteristics of fuels are met. Finally, refining is necessary to meet quality standards for specific hydrocarbon products and to convert the petroleum derived compounds into suitable feedstocks for petrochemical plants. The required refining can be done in several ways. One of the more established methods employs sequential catalytic hydrotreating and catalytic hydrocracking. This is a well developed process used in a number of petroleum refineries.

Typical feedstocks include virtually any heavy mineral (petroleum derived) or synthetic oil fraction having boiling points above about 400° F. (204° C.). Thus, such feedstocks as straight run gas oils, vacuum gas oils, demetallized oils, coker distillates, cat cracker distillates, and the like are contemplated. The preferred feedstock should not contain appreciable asphaltenes. The hydrocracking feedstock may contain nitrogen, usually present as organonitrogen compounds in amounts between 1 ppm and 1.0 wt. %. The feed will normally also contain sulfur containing compounds sufficient to provide a sulfur content greater than 0.15 wt. %. It may also contain mono- and/or polynuclear aromatic compounds in amounts of 35 volume percent and higher. The compounds in the feed to the hydrotreating zone may have boiling points within the broad range extending from about 400° F. (204° C.) to about 1100° F. (593° C.) and preferably within the range of from about 600° F. (316° C.) to about 1020° F. (550° C.). The feed will often be a blend of materials derived from two or more different sources such as a crude oil atmospheric or vacuum column and a conversion unit. The feeds to the subject process are expected to contain a sizeable amount, e.g. 20–40 vol. % of diesel boiling range hydrocarbons requiring little conversion.

Over the years great advances have been made in both hydrotreating and hydrocracking catalysts and process technology. Nevertheless, compromises between operating variables are still required in order to optimize specific process units, and improvement in hydrocracking selectivity and hydrotreatment ability remain an industry-wide goal. One area in which hydrotreatment ability is very important is in the field of low conversion hydrocracking.

While being an overall low conversion process, the invention employs a high severity hydrocracking zone. However, the amount of material and the composition of the feed to the hydrocracking zone is controlled to limit overall conversion. This concept is based upon the realization that a high severity hydrocracking zone provides excellent hydrotreating at the same pressure as the hydrotreating zone. The limited overall conversion provided by the process is highly desired in those instances where the heaviest material produced by the process is charged into a downstream process which converts the hydrocarbons to valuable products. In these instances, it is very much desired to produce a sizable bottoms stream of high boiling hydrotreated material. This bottoms stream may have a flow rate equal to about 20–45 vol. % of the feed. The objective is to only hydrotreat this high boiling material.

The subject invention targets feeds containing a sizeable amount of material boiling below about 700° F. It is often desired to upgrade this 700° F. minus fraction. This upgrading, in the form of hydrotreating, often will require the use of extremely high pressures in order to achieve the desired level of overall sulfur removal and paraffin saturation. The use of hydrotreating pressures in the range of 2,000 to 3,000 psi or higher dictates the need for more expensive, thicker wall vessels, transfer lines and other equipment. Further, resorting to a brute force high pressure hydrotreating step results in excessive hydrogenation of some fractions of the feed. This is an inefficient usage of high value hydrogen. Therefore, it is desired to operate the process at the lowest pressure which accomplishes the required hydrotreatment. One objective of the process is, therefore, to provide a process which performs a high level of hydrotreatment without using a high operating pressure, e.g. above 2000 psig (13790 kPa). Another objective of the invention is to provide a flexible process which can vary the overall degree of feed stream hydrotreating. It is an objective of the subject process to provide a selective low conversion hydrocracking process for processing relatively light feeds which require only limited cracking for conversion to the desired products. It is a specific objective of the invention to provide a selective hydrocracking process for use with feed streams that contain a significant amount of hydrocarbons which already boil in the desired product boiling point range.

In a representative example of a conventional high conversion hydrocracking process, a heavy gas oil is charged to the process and admixed with a hydrocarbon recycle stream. The resultant admixture of these two liquid phase streams is heated in an indirect heat exchange means and then combined with a hydrogen-rich gas stream. The admixture of charge hydrocarbons, recycle hydrocarbons and hydrogen is heated in a fired heater and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

There is thereby produced a reaction zone effluent stream which comprises an admixture of the remaining hydrogen which is not consumed in the reaction, light hydrocarbons such as methane, ethane, propane, butane, and pentane formed by the cracking of the feed hydrocarbons, and other reaction by-products such as hydrogen sulfide and ammonia formed by hydrodesulfurization and hydro-denitrification reactions which occur within the hydrocracking zone. The reaction zone effluent will also contain the desired product hydrocarbons boiling in the gasoline, diesel fuel, kerosene and/or fuel oil boiling point ranges and some unconverted feed hydrocarbons boiling above the boiling point ranges of the desired products. The effluent of the hydrocracking reaction zone will, therefore, comprise an extremely broad and varied mixture of individual compounds.

The hydrocracking reaction zone effluent is typically removed from contact with the catalyst bed, heat exchanged with the feed to the reaction zone for heat recovery and then passed into a vapor-liquid separation zone normally which includes a high pressure separator. Additional cooling can be done prior to this separation. In some instances a hot flash separator is used upstream of the high pressure separator. The use of downstream "cold" separators to remove condensate formed from vapor removed from a hot separator is another option. The liquids recovered in these vapor-liquid separation zones are passed into a product recovery zone containing one or more fractionation columns. Product recovery methods for hydrocracking are well known and conventional methods may be employed in the subject invention. In most instances the conversion achieved in a high conversion reactor(s) is not complete and some heavy hydrocarbons are removed from the product recovery zone as a "drag stream", and/or as the hydrocarbon recycle stream. The recycle stream is often passed into the hydrotreating reactor, if the overall process includes a hydrotreating reactor, as this normally reduces the capital cost of the overall unit. It may, however, be passed directly into a hydrocracking reactor. A net drag stream may be removed from a high conversion hydrocracking process. This allows the use of less severe conditions in the reaction zone(s). The size of the drag stream in a high conversion process can be in the broad range of 2–10 volume percent of the process feed stream, but is preferably in the range of 1–5 volume percent.

In the subject process the feed stream is first subjected to a hydrotreating step. This has traditionally been practiced as a means of removing sulfur and nitrogen from the feedstock in order to prepare it for the downstream hydrocracking reactors. One reason for this is that a lower sulfur or nitrogen content tends to increase the observed activity of the hydrocracking catalyst. The hydrotreating zone is a treating zone rather than conversion or cracking zone. The effluent from the hydrotreating zone will preferably comprise an admixture of hydrocarbons having essentially the same boiling point range as the feed which enters the hydrotreating zone. Only a small amount, preferably less than 10%, conversion by cracking occurs in the hydrotreating zone. Most preferably less than 5% conversion occurs in the hydrotreating zone. This conversion will produce some lower boiling hydrocarbons, but the majority of the feed preferably passes through the hydrotreating zone with only a minor boiling point change. Conversion is normally undesired in a hydrotreating process as it reduces the yield and quality of the intended middle distillate products. The term "conversion" as used herein refers to the chemical change necessary to convert feed stream molecules into product hydrocarbons which become part of a distillate product, as compared to bottoms or drag material, recovered from the effluent of the respective reaction zone. Conversion, therefore, does not relate to hydrotreating or other reactions which do not significantly reduce the boiling point of the molecules.

An identifying characteristic of the subject process is the use of two high pressure separators (HPS) in series. These separators are employed in a modified series flow arrangement unique to the process. Since a separator by definition performs a division of the entering material, two separators cannot be truly used in series to perform the same separation. However, in the subject process some of the material separated in the first HPS is recombined and fed into the second HPS. Preferably at least 25 volume percent of each of the intermediate and heavy fractions withdrawn from the augmented first high pressure separator is passed into the second high pressure separator. An additional quantity preferably equal to at least 25 volume percent of each of the heavy and intermediate fractions withdrawn from the augmented high pressure separator is passed directly into the hydrocracking reaction zone.

The first HPS is referred to herein as an "augmented" separator since it preferably contains some limited aids to separation or "internals" such as trays and/or structured packing to promote a better separation than provided by a simple one-stage flash separation. For instance, the augmented high pressure separator (AHPS) may contain a total of about four perforated trays. These internals will also facilitate the collection of the intermediate fraction removed from the second HPS. The high pressure in these vessels require thick vessel walls and conduits which greatly increases the costs of the equipment to a degree that a full fractionation device such as a column is prohibitively expensive. There is thus no external reflux or reboiling in the AHPS. Thus the separation performed in the AHPS will be inexact and there will be considerable overlap of boiling point ranges of the adjoining fractions removed from the AHPS.

The drawing is a simplified process flow diagram which does not show customary equipment required for performance of the process such as valves, pumps, and control systems. The drawing is intended only to illustrate the inventive concept and not to limit the scope of the invention. Referring now to the drawing, the feed stream enters the process via line 1 and is admixed with a hydrogen-rich gas stream passing through line 18. As used herein the term "rich" is intended to indicate the molar concentration of the indicated chemical or class of compounds is greater than 50 percent and preferably greater than 70 percent. The admixture of hydrogen and the feed stream flowing through line 2 may be heated by a means not shown. It is passed into the a hydrotreating reaction zone represented by the reactor 3. The reactions which occur in this zone result in the formation of hydrogen sulfide and ammonia and some light hydrocarbons by undesired side reactions but no substantial cracking of the heavier hydrocarbons which enter the reactor. There is thereby formed a mixed phase hydrotreating reaction zone effluent stream which is passed through line 4 into a first or augmented high pressure separator (AHPS) 5. This effluent stream comprises gases such as hydrogen, reaction products and liquid phase feed hydrocarbons.

The internals and operation of the AHPS 5 are chosen to promote the separation of the entering compounds into three different fractions of overlapping composition. The lightest fraction is the 300° F. minus vapor-phase fraction removed through line 8 and passed into a second high pressure separator 10 via line 9. This fraction will contain the great majority of the hydrogen, volatile compounds, and light hydrocarbons having boiling points less than 300° F. which enter the first HPS. An intermediate second fraction intended to predominate in hydrocarbons boiling between about 300 and 700° F. is removed through line 7, and a liquid-phase heavy fraction rich in hydrocarbons boiling above 700° F. is removed through line 6. In the subject process both the intermediate fraction and the heavy fraction are then separated into at least two separate portions which are handled differently.

A first portion equal to about 25 to about 80 vol. percent of the intermediate fraction of line 7 is passed into the second high pressure separator 10 via lines 19 and 21 by admixture with the light fraction of line 8 as shown. A second portion equal to at least 20 vol. percent of the intermediate fraction is Is diverted through line 20 for ultimate passage into the downstream hydrocracking reaction zone. In a similar manner a first portion equal to about 40 to about 85 vol. percent of the heavy fraction of line 6 is passed through line 21 to the second high pressure separator 10, and a second portion equal to at least 25 vol. percent of the heavy fraction is passed through line 22 into the line 23 for eventual passage into the hydrocracking reaction zone represented by reactor 25. The division of both the intermediate and heavy fractions is preferably controlled by flow control valves not shown to allow independent variation in the amount of each fraction which is passed into the HPS 10 and into the reactor 25. Thus the amount of material fed to the hydrocracking zone can be adjusted to compensate for changes in the feed stream composition or in the desired product slate. In any event the portion of the two streams passed into the HPS 10 bypasses the hydrocracking reactor and thus is only subjected to hydrotreating.

The gases and liquid-phase materials fed into the second high pressure separator 10 are separated into vapor and liquid phase fractions, with the entire liquid-phase fraction being passed into the low pressure flash drum (LPFD) 28 via line 27. The lower pressure in this separator causes vaporization of dissolved gases and light hydrocarbons which are removed in line 29 for passage into a gas processing zone. The remaining liquid phase fraction formed in this separation is passed via line 30 into a fractionation zone represented by the single column 31, although often comprising both a stripping column and at least one separation column. The liquid of line 30 is separated into distillate products such as a light naphtha of line 32, a kerosene of line 33 and a diesel boiling range product stream of line 34. The heaviest components are removed as a stream of unconverted oil carried by line 35. While characterized as unconverted oil, all of the hydrocarbons in this stream have been upgraded by hydrotreating and this material could also be referred to a stream of hydrotreated heavy hydrocarbons. Because of the hydrotreating this material will be very suitable as feedstock to a number of units including ethylene crackers, FCC units and lube oil plants.

The vapor-phase fraction removed from the second high pressure separator via line 11 is preferably cooled to an intermediate temperature by a heat exchanger not shown and then passed into an optional scrubbing zone 12 where it is contacted with a liquid which adsorbs hydrogen sulfide. The cooling may cause condensation which would be handled via a separator not shown. The gas is removed from the scrubbing zone in line 13 and pressurized in the recycle gas compressor 14. The thus purified and hydrogen-rich recycle gas stream is then divided into the portion passed into the hydrotreating reactor 3 via line 16 and the portion passed into the hydrocracking zone reactor 25 via lines 15 and 24. The gas in line 15 is first admixed with the portions of the heavy and intermediate fractions removed from the first HPS 5 carried by line 23. This admixture is then passed into the hydrocracking reaction zone which may actually comprise two or more reactors in series or parallel flow. The contact of these hydrocarbons with the hydrocracking catalyst results in significant cracking of the entering hydrocarbon molecules into smaller molecules and the formation of additional products which eventually flow to the column 31. The mixed-phase effluent of the hydrocracking zone is passed via line 26 into the second high pressure separator 10.

The amounts of the intermediate fraction of line 7 and of the heavy fraction of line 6 which are passed into the hydrocracking reactor are separately controlled. As the intermediate fraction already boils primarily in the distillate product boiling point ranges, the percentage of the intermediate fraction passed into the hydrocracking zone is expected to normally be less than that of the heavy fraction. While it is preferred that at least 25 vol. percent of each fraction is passed into the second HPS 10, the percentage can be much higher and reach 80 and 85 percent respectively. Thus, over three quarters of the feed stream may bypass the hydrocracking zone. Most of the heavy fraction will become part of the heavy hydrotreated product of line 35 with the result that this stream can have a flow rate equal to about 20 to about 60 vol. percent of the feed stream. The boiling point range of the feed and operational capability of the product fractionation columns will have a large impact on the amount of heavy bottoms produced by the process.

The subject process employs two different types of catalyst, hydrotreating catalyst and hydrocracking catalyst. These two types of catalysts normally share many similarities. For instance, they may have relatively similar particle shape and size. Both normally comprise an inorganic support material and at least one hydrogenation metal. The two types of catalysts will, however, also differ significantly since each has been tailored to perform a different function. One of the most obvious differences is that the hydrocracking catalyst will also comprise one or more acidic cracking components, such as silica-alumina and/or a zeolite. The two types of catalysts are also expected to differ in other ways such as in terms of the metals employed as the hydrogenation component, the particle's pore volume distributions and density, etc. Suitable catalysts for use in all reaction zones of this process are available commercially from several vendors. Hydrotreating catalysts typically do not contain zeolitic materials or molecular sieve materials and often comprise only one or more metals on an amorphous alumina. Much of the art and technology involved with the production of hydrotreating catalyst is centered upon the identity and amount of the metals in the catalyst, the methods chosen for the impregnation of the metals into the catalyst, the relative metal concentration profiles, the pore structure of the alumina and the overall geometry of the catalyst particle.

Both the hydrocracking and hydrotreating catalyst will typically comprise a base metal hydrogenation component chosen from nickel, cobalt, molybdenum and tungsten and possibly promoters such as phosphorous supported on an inorganic oxide catalyst. The hydrogenation metals are usually a Group VIB and/or a Group VIII metal component, with each metal being present at a concentration based upon the finished catalyst equal to about to 2 to about 18 wt. % measured as the common metal oxide. The catalysts are preferably essential free of any platinum-group metal including platinum, palladium, rhodium, osmium, and iridium due to the higher costs of these metals. However, they could be employed in either catalyst, if desired, as they tend to have higher hydrogenation activities. A platinum group metal is preferably present at a lower concentration of about 0.1 to 1.5 wt. %. If used phosphorus is normally present in the catalyst in the range of 1 to 30 wt. % and preferably 3 to 15 wt. % calculated as $P_2O_5$. A preferred form of the catalysts is an extrudate having a symmetrical cross-sectional shape, which is preferably a cylindrical or polylobal shape. The cross-sectional diameter of the particles is usually from about 1/40 to about 1/8 inch and preferably about 1/32 to about 1/12 inch. A quadralobal cross-sectional shape resembling that of a four leaf clover is shown in U.S. Pat. No. 4,028,227. Other shapes which may be employed in the catalysts are described in this patent and in U.S. Pat. No. 4,510,261. These patents are incorporated herein for their teaching as to the production of catalysts and the potential particle shapes which may be employed for both catalysts employed in the subject invention.

One preferred hydrotreating catalyst comprises a hydrogenation component comprising nickel and molybdenum on an extruded porous support of phosphorous containing alumina. Details on the production of hydrotreating catalysts containing these four components are provided in U.S. Pat. Nos. 4,738,944; 4,818,743 and 5,389,595 which are incorporated herein for this teaching.

Hydrogenation components may be added to the catalysts before or during the forming of the catalyst particles, but the hydrogenation components of the hydrocracking catalyst are preferably composited with the formed support by impregnation after the zeolite and inorganic oxide support materials have been formed to the desired shape, dried and calcined. Impregnation of the metal hydrogenation component into the catalyst particles may be carried out in any manner known in the art including evaporative, dip and vacuum impregnation techniques.

The total pore volume of both the hydrotreating and hydrocracking catalysts should be within the broad range of about 0.2 to about 1.0 cc per gram and preferably between about 0.25 to about 0.7 cc per gram. The finished catalyst should have a surface area greater than about 100 meters per gram and preferably between about 100 and 300 meters per gram as measured by mercury porosity. The finished catalysts for utilization in the subject process should have a surface area of about 200 to 700 square meters per gram, an average pore diameter of about 20 to about 300 Angstroms, and apparent bulk density within the range of from about 0.50 to about 0.90 gram/cc. Surface areas above 350 $m^2/g$ are greatly preferred.

Both the hydrotreating and hydrocracking catalysts preferably comprise a support material which is highly porous, uniform in composition and relatively refractory to the conditions utilized in the hydrocarbon conversion process. The term "uniform in composition" denotes a support which is unlayered, has no concentration gradients of the species inherent to its composition, and is completely homogeneous in composition to the extent feasible in mass production. Thus, if the support is a mixture of two or more refractory materials, the relative amounts of these materials will be constant and uniform throughout the entire support. The catalyst may comprise a variety of support materials which have traditionally been utilized in hydrocarbon conversion catalysts such as refractory inorganic oxides including alumina, titanium dioxide, magnesia, boria, silica-alumina, chromia-alumina, alumina-boria, etc.; and clays and silicates including those synthetically prepared and naturally occurring, for example attapulgus clay, diatomaceous earth, fuller's earth, kaolin, kieselguhr, etc. The preferred support material for the hydrotreating catalyst is alumina. Suitable aluminas are the crystalline aluminas known as the gamma-, eta-, and theta-aluminas. Excellent results are obtained with a matrix of substantially pure gamma-alumina.

An alumina component of either of the two catalysts used in the process may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. One preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A second preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The composition and physical characteristics of the catalysts such as shape and surface area are not considered to be limiting upon the utilization of the present invention. The catalysts may, for example, exist in the form of pills, pellets, granules, broken fragments, spheres, or various special shapes such as trilobal extrudates, disposed as a fixed bed within a reaction zone. Alternatively, the catalysts may be prepared in a suitable form for use in moving bed reaction zones in which the hydrocarbon charge stock and catalyst are passed either in countercurrent flow or in co-current flow. Another alternative is the use of a fluidized or ebulated bed hydrocracking reactor in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in the liquid or mixed phase, and in either upward or downward flow. The reaction zones, therefore, do not need to be fixed bed systems such as depicted on the Drawing.

The catalyst particles may be prepared by any known method in the art including the well-known oil drop and extrusion methods. A preferred form for the catalysts used in the subject process is an extrudate.

A spherical catalyst for use in either the hydrotreating section or the hydrocracking section of the process may be formed by use of an oil dropping technique such as described in U.S. Pat. Nos. 2,620,314; 3,096,295; 3,496,115 and 3,943,070 which are incorporated herein by reference. This method involves dropping the mixture of molecular sieve, alumina sol, and gelling agent into an oil bath maintained at elevated temperatures. The droplets of the mixture remain in the oil bath until they set to form hydrogel spheres. The spheres are then continuously withdrawn from the initial oil bath and typically subjected to specific aging treatments in oil and an ammoniacal solution to further improve their physical characteristics. Zeolite and/or silica-alumina must be admixed into the aluminum containing sol prior to the initial dropping step. Other references describing oil dropping techniques for catalyst manufacture include U.S. Pat. Nos. 4,273,735 and 4,542,113. The production of spherical catalyst particles by different methods is described in U.S. Pat. Nos. 4,599,321; 4,628,040 and 4,640,807.

It is preferred that the hydrocracking catalyst comprises between 1 wt. % and 90 wt. % Y zeolite, preferably between 10 wt. % and 80 wt. %. The zeolitic catalyst composition should also comprise a porous refractory inorganic oxide support (matrix) which may form between about 10 and 99 wt. %, and preferably between 20 and 90 wt. % of the support of the finished catalyst composite. The matrix will typically also comprise a porous refractory inorganic oxide as described above. A preferred matrix comprises a mixture of silica-alumina and alumina wherein the silica-alumina comprises between 15 and 85 wt. % of said matrix. It is also preferred that the support comprises from about 5 wt. % to about 45 wt. % alumina.

A Y zeolite has the essential X-ray powder diffraction pattern set forth in U.S. Pat. No. 3,130,007. The as synthesized zeolite is modified by techniques known in the art which provide a desired form of the zeolite. A Y-type zeolite preferred for use in the present invention has been modified by known methods to possess a unit cell size between about 24.20 Angstroms and 24.45 Angstroms. Preferably, the zeolite unit cell size will be in the range of about 24.20 to 24.40 Angstroms and most preferably about 24.30 to 24.38 Angstroms. The Y zeolite is preferably dealuminated and has a framework $SiO_2:Al_2O_3$ ratio greater than 6, most preferably between 6 and 25. These zeolites have been described in the patent literature. It is contemplated that other zeolites, such as Beta, Omega, L or ZSM-5, could be employed as the zeolitic component of the hydrocracking catalyst in place of or in addition to the preferred Y zeolite.

Hydrocarbons removed from the bottom of the product recovery column as a bottoms stream are a high value product but are not considered to be either distillates or conversion products for purposes of the definition of conversion given above. The desired "distillate" products of a hydrocracking process are normally recovered as sidecuts of a product fractionation column and include the naphtha, kerosene and diesel fractions. The distillate product distribution of the subject process is set by the feed composition and the selectivity of the catalyst(s) at the conversion rate obtained in the reaction zones at the chosen operating conditions. It is, therefore, subject to considerable variation. The subject process is especially useful in the production of middle distillate fractions boiling in the range of about 260–700° F. (127–371° C.) as determined by the appropriate ASTM test procedure.

The term "middle distillate" is intended to include the diesel, jet fuel and kerosene boiling range fractions. The terms "kerosene" and "jet fuel boiling point range" are intended to refer to about 260–550° F. (127–288° C.) and diesel boiling range is intended to refer to hydrocarbon boiling points of about 260—about 700° F. (127–371° C.). The gasoline or naphtha fraction is normally considered to be the $C_5$ to 400° F. (204° C.) endpoint fraction of available hydrocarbons. The boiling point ranges of the various product fractions recovered in any particular refinery will vary with such factors as the characteristics of the crude oil source, the refinery's local markets, product prices, etc. Reference is made to ASTM standards D-975 and D-3699 for further details on kerosene and diesel fuel properties and to D-1655 for aviation turbine feed. These definitions provide for the inherent variation in feeds and desired products which exists between different refineries. Typically, product specifications will require the production of distillate hydrocarbons having boiling points below about 700° F. (371° C.).

While the hydrotreating zones are characterized as maintained at hydrotreating conditions and the hydrocracking zone(s) are kept at hydrocracking conditions, these conversion conditions are somewhat similar. The pressure maintained in both the hydrotreating and hydrocracking reaction zones should be within the broad range of about 1000 to 2500 psia (6895–17,237 kPa). It is preferred to employ a pressure above 1500 psia (10,343 kPa) in the hydrocracking zone. The reaction zones are preferably operated with a hydrogen to hydrocarbon ratio of about 5,000 to 18,000 standard cubic feet of hydrogen per barrel of feedstock (889 to 3200 standard meter$^3$ per meter$^3$). The hydrotreating zones may be operated at an inlet temperature of about 450 to 670° F. (232–354° C.). The hydrocracking zones may be operated with an inlet temperature of 640–800° F. (338–426° C.). In the subject process the reaction zones are operated at conditions which include liquid hourly space velocities of from about 0.2 to 10 hr$^{-1}$, and preferably about 1.0 to about 2.5 hr$^{-1}$. Conditions in the hydrocracking zone should be adjusted to obtain a per pass conversion above 50 vol. % and preferably above 60 vol. %.

One embodiment of the invention may accordingly be characterized as a hydrocarbon conversion process, which process comprises passing a feed stream comprising hydrocarbons having boiling points above 400° F. and hydrogen into a hydrotreating reaction zone operated at hydrotreating conditions and producing a hydrotreating reaction zone effluent stream comprising hydrogen, hydrogen sulfide, and unconverted feed hydrocarbons having boiling points above about 400° F.; separating the hydrotreating reaction zone effluent stream in an augmented first high pressure separation zone into a light fraction comprising hydrogen and hydrocarbons having boiling points below about 300° F., an intermediate fraction which is rich in hydrocarbons having boiling points between about 300° F. and about 700° F., and a heavy fraction comprising hydrocarbons having boiling points above about 700° F.; passing the light fraction and a controlled portion of each of the intermediate and heavy fractions into a second high pressure separator that separates the entering compounds into a vapor phase process stream and a liquid phase process stream; passing at least a portion of the vapor phase process stream into the hydrotreating reaction zone; passing the remainder of the intermediate and heavy fractions into a hydrocracking reaction zone operated at hydrocracking conditions, and producing a hydrocracking reaction zone effluent stream; passing the hydrocracking reaction zone effluent stream into the second high pressure separator; and, passing the liquid phase process stream withdrawn from the second high pressure separator into a product recovery zone, and recovering at least one distillate hydrocarbon product stream.

We claim as our invention:

1. An integrated hydrocarbon conversion process which employs both a hydrocracking reactor and a hydrotreating reactor, which process comprises:

a.) passing a feed stream comprising hydrocarbons having boiling points above 400° F. and hydrogen into a hydrotreating reaction zone operated at hydrotreating conditions and producing a hydrotreating reaction zone effluent stream comprising hydrogen, hydrogen sulfide, and hydrocarbons having boiling points above about 400° F.;

b.) separating the hydrotreating reaction zone effluent stream in an augmented first high pressure separator into a light fraction comprising hydrocarbons having boiling points below about 300° F., an intermediate fraction which is rich in hydrocarbons having boiling points between about 300° F. and about 700° F., and a heavy fraction comprising hydrocarbons having boiling points above about 700° F.;

c.) passing the light fraction and a controlled first portion of each of the intermediate and heavy fractions into a second high pressure separator;

d.) passing the remaining second portion of the intermediate and heavy fractions and hydrogen into a hydrocracking reaction zone operated at hydrocracking conditions, and producing a hydrocracking reaction zone effluent stream;

e.) passing the hydrocracking reaction zone effluent stream into the second high pressure separator; and, f.) passing a liquid phase stream withdrawn from the second high pressure separator into a product recovery zone, and recovering at least one distillate hydrocarbon product stream.

2. The process of claim 1 wherein the second high pressure separator operates at a pressure within 100 psi of the pressure maintained in the first high pressure separator.

3. The process of claim 1 wherein at least 20 volume percent of the intermediate and at least 25 volume percent of the heavy fraction withdrawn from the augmented high pressure separator is passed into the hydrocracking reaction zone.

4. The process of claim 3 wherein at least 25 volume percent of the intermediate and heavy fractions withdrawn from the augmented high pressure separator is passed into the second high pressure separator.

5. A hydrocarbon conversion process, which process comprises:

a.) passing a feed stream comprising hydrocarbons having boiling points above 400° F. and hydrogen into a hydrotreating reaction zone operated at hydrotreating conditions and producing a hydrotreating reaction zone effluent stream comprising hydrogen, hydrogen sulfide, and unconverted feed hydrocarbons having boiling points above about 400° F.;

b.) separating the hydrotreating reaction zone effluent stream in an augmented first high pressure separator into a light fraction comprising hydrogen and hydrocarbons having boiling points below about 300° F., an intermediate fraction which is rich in hydrocarbons having boiling points between about 300° F. and about 700° F., and a heavy fraction comprising hydrocarbons having boiling points above about 700° F.;

c.) passing the light fraction and a controlled portion of each of the intermediate and heavy fractions into a second high pressure separator that separates the entering compounds into a vapor phase process stream and a liquid phase process stream;

d.) passing at least a portion of the vapor phase process stream into the hydrotreating reaction zone;

e.) passing the remainder of the intermediate and heavy fractions into a hydrocracking reaction zone operated at hydrocracking conditions, and producing a hydrocracking reaction zone effluent stream;

f.) passing the hydrocracking reaction zone effluent stream into the second high pressure separator; and, g.) passing the liquid phase process stream withdrawn from the second high pressure separator into a product recovery zone, and recovering at least one distillate hydrocarbon product stream.

6. The process of claim 5 wherein from about 25 to about 80 volume percent of the intermediate fraction is passed into the second high pressure separator.

7. The process of claim 6 wherein between about 40 to about 85 percent of the heavy fraction is passed into the second high pressure separator.

8. The process of claim 5 wherein between about 40 to about 85 percent of the heavy fraction is passed into the second high pressure separator.

9. The process of claim 8 wherein a hydroprocessed bottoms stream having a flow rate equal to about 20–60 vol. percent of the feed stream is withdrawn from the product recovery zone.

* * * * *